US008836740B2

(12) United States Patent
Sugimura

(10) Patent No.: US 8,836,740 B2
(45) Date of Patent: Sep. 16, 2014

(54) PRINTER

(71) Applicant: Yoshihiko Sugimura, Nagoya (JP)

(72) Inventor: Yoshihiko Sugimura, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/141,545

(22) Filed: Dec. 27, 2013

(65) Prior Publication Data

US 2014/0104361 A1 Apr. 17, 2014

Related U.S. Application Data

(63) Continuation-in-part of application No. PCT/JP2012/058292, filed on Mar. 29, 2012.

(30) Foreign Application Priority Data

Jun. 30, 2011 (JP) ..... 2011-145609

(51) Int. Cl.

| | |
|---|---|
| ***B41J 3/46*** | (2006.01) |
| ***B41J 29/38*** | (2006.01) |
| ***B41J 11/70*** | (2006.01) |
| ***B41J 3/407*** | (2006.01) |

(52) U.S. Cl.

CPC ..... *B41J 29/38* (2013.01); *B41J 11/703* (2013.01); *B41J 3/4075* (2013.01); *B41J 3/46* (2013.01)

USPC ..... 347/171

(58) Field of Classification Search

USPC ..... 347/171; 400/703

See application file for complete search history.

(56) References Cited

U.S. PATENT DOCUMENTS

2005/0007606 A1 1/2005 Miyasaka
2014/0072358 A1 * 3/2014 Tomomatsu et al. ..... 400/583

FOREIGN PATENT DOCUMENTS

| | | |
|---|---|---|
| JP | 05-28134 | 2/1993 |
| JP | 07-160688 | 6/1995 |
| JP | 2001-205902 | 7/2001 |
| JP | 2004-355510 | 12/2004 |
| JP | 2006-168333 | 6/2006 |
| JP | 2009-149108 | 7/2009 |
| JP | 2011-025411 | 2/2011 |
| JP | 2011-062985 | 3/2011 |

OTHER PUBLICATIONS

Computer-generated translation of JP 2001-205902, published on Jul. 2001.*

International Preliminary Report on Patentability issued in Application No. PCT/JP2012/058292 on Jan. 16, 2014.

International Search Report for Application No. PCT/JP2012/058292, issued on Jun. 2012.

* cited by examiner

*Primary Examiner* — Huan Tran

(74) *Attorney, Agent, or Firm* — McCarter & English, LLP

(57) ABSTRACT

A printer comprises a print head, a discharge port, a display portion, and a processor. The processor displays a head marker indicating a position of the print head and a discharge port marker indicating a position of the discharge port on the display portion in correspondence to a positional relationship of the print head and the discharge port. The processor also displays, in real-time on the display portion, an image of the print medium on which the print image has been printed, in accordance with the printing by the print head, such that the image is initially displayed in a state in which a start edge of the image is aligned with the head marker when the printing by the print head starts, and a position of the initially displayed image is moved toward the discharge port marker in accordance with progress of the printing by the print head.

6 Claims, 10 Drawing Sheets

PRINTER

This application is a continuation-in-part of International Application No. PCT/JP2012/058292, filed Mar. 29, 2012, which claims priority from Japanese Patent Application No. 2011-145609, filed on Jun. 30, 2011. The disclosure of the foregoing application is hereby incorporated by reference in its entirety.

BACKGROUND

The present disclosure relates to a printer that is provided with a display portion.

A printer is known that can perform printing on a print medium using a print head while displaying, on a display portion, an image of the print medium on which the printing is being performed. For example, a document printing and editing method is known in which printing is temporarily stopped during printing of a document, display is performed while distinguishing between an area on which printing is complete and an area that has not yet been printed, and the document can be edited during printing. A user can continue the printing after completing the editing.

SUMMARY

However, the internal configuration of the printer cannot be seen as it is hidden by a housing. For that reason, even though the printer performs the printing while displaying the image on the display portion, the user does not know which part of the print medium is passing the print head, and which part of the print medium is passing through the discharge port. As a result, there are cases in which the user cannot ascertain the printing situation inside the printer in real time.

Embodiments of the broad principles derived herein provide a printer that can make visible a printing situation inside the printer.

Embodiments provide a printer includes a print head, a discharge port, a display portion, and a processor. The print head performs printing of a print image on a print medium, based on print data. The discharge port discharges the print medium to the outside after the printing by the print head. The display portion displays various images. The processor is configured to display a head marker indicating a position of the print head and a discharge port marker indicating a position of the discharge port on the display portion in correspondence to a positional relationship of the print head and the discharge port. The processor is also configured to display, in real-time on the display portion, an image of the print medium on which the print image has been printed, in accordance with the printing by the print head, such that the image is initially displayed in a state in which a start edge of the image is aligned with the head marker when the printing by the print head starts, and a position of the initially displayed image is moved toward the discharge port marker in accordance with progress of the printing by the print head.

Embodiments provide also a printer includes a print head, a discharge port, a display portion, and a processor. The print head performs printing of a print image on a print medium, based on print data. The discharge port discharges the print medium to the outside after the printing by the print head. The display portion displays various images. The display portion is provided with a head marker indicating a position of the print head and a discharge port marker indicating a position of the discharge port in correspondence to a positional relationship of the print head and the discharge port. The processor is configured to display, in real-time on the display portion, an image of the print medium on which the print image has been printed during printing by the print head, such that the image is initially displayed in a state in which a start edge of the image is aligned with the head marker, when the printing by the print head starts, and a position of the initially displayed image is moved toward the discharge port marker in accordance with progress of the printing by the print head.

BRIEF DESCRIPTION OF THE DRAWINGS

Embodiments will be described below in detail with reference to the accompanying drawings in which.

DETAILED DESCRIPTION

Figure 1:
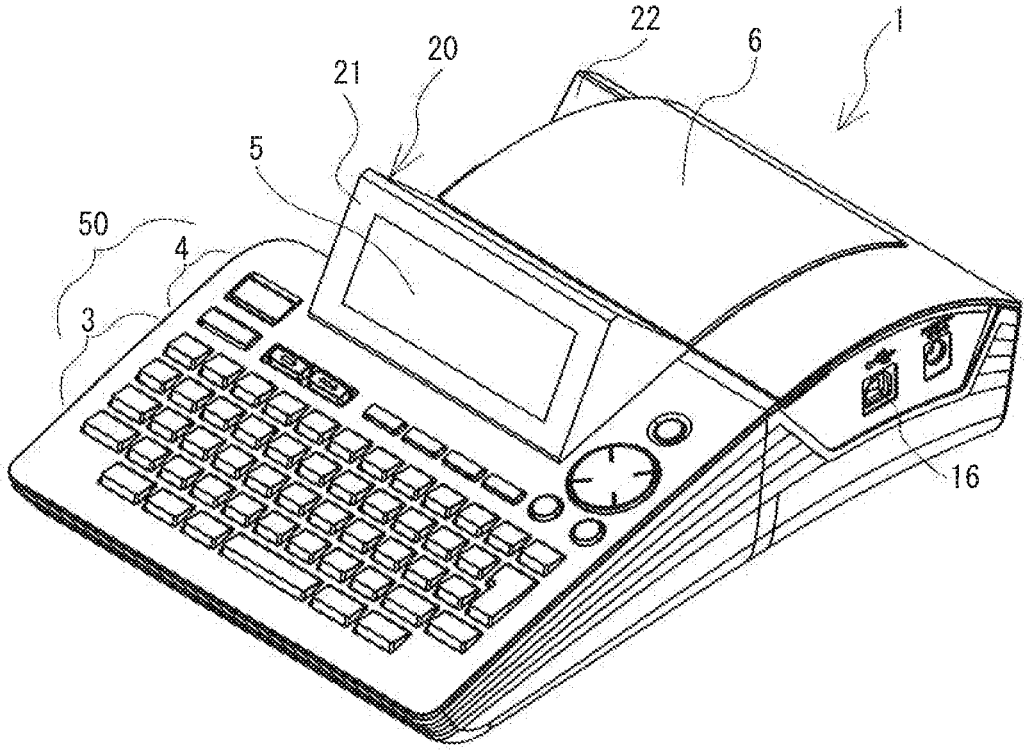
FIG. 1 is a perspective view of a printer.

Hereinafter, a printer 1 that is an embodiment of the present disclosure will be explained with reference to the drawings. The drawings referred to are used to explain technological features that can be adopted by the present disclosure. Device configurations and the like that are shown in the drawings are simply explanatory examples and do not limit the present disclosure to only those examples.

Figure 2:
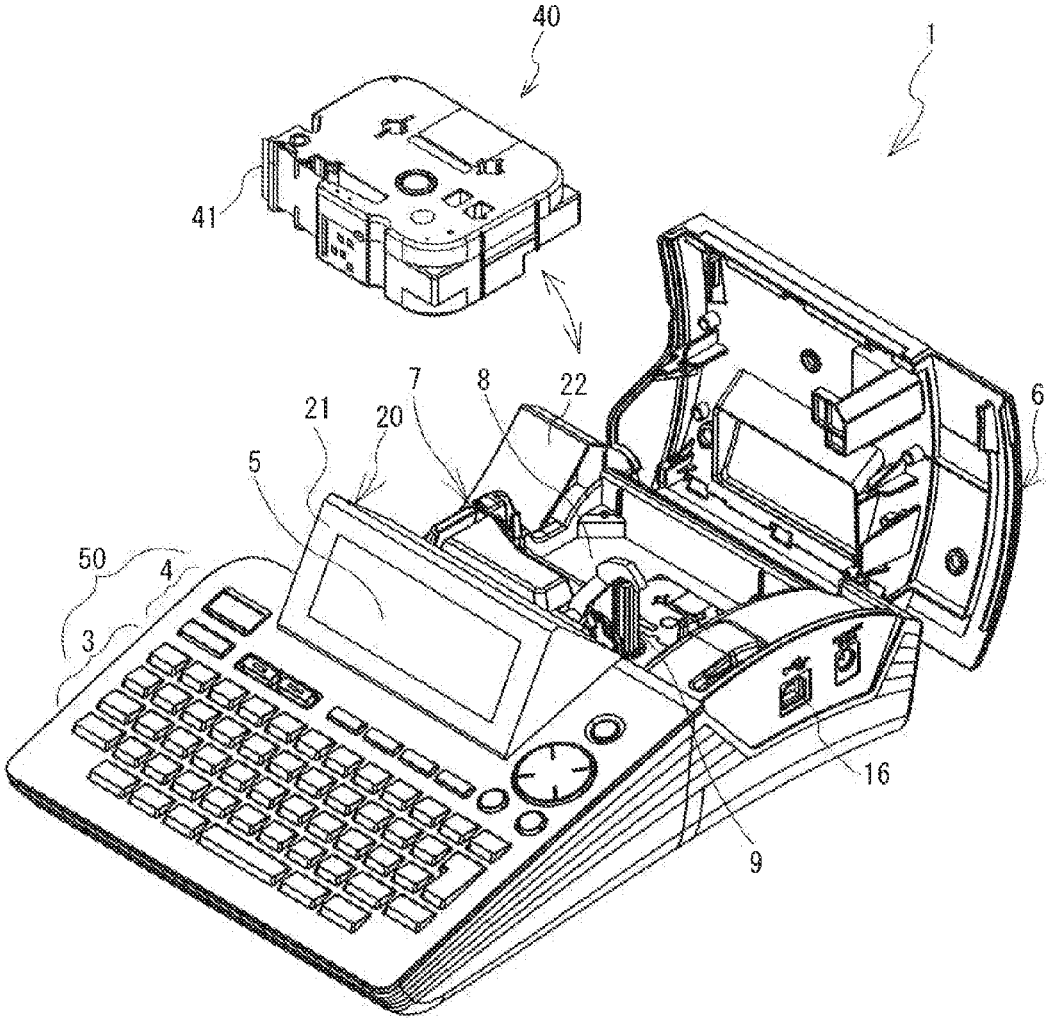
FIG. 2 is a perspective view of the printer with a tape cassette mounted in a cassette mounting portion.
Figure 3:
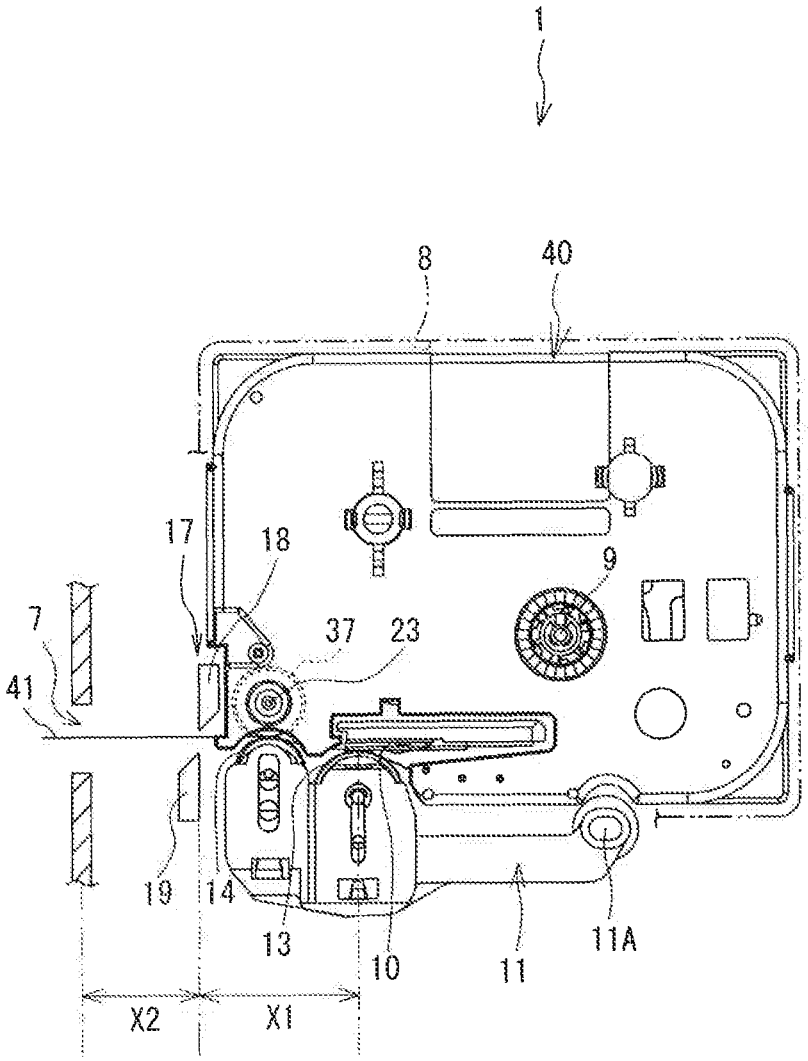
FIG. 3 is a diagram showing positional relationships of a thermal head, a cutter mechanism and a discharge port.

In the following explanation, the lower left direction, the upper right direction, the lower right direction and the upper left direction in FIG. 1 and FIG. 2 are, respectively, the front, the rear, the right and the left of the printer 1. Further, in FIG. 1, a direction from the lower right toward the upper left, in which a label tape 41 is fed, is a tape feed direction. The right side and the left side in FIG. 3 are the right side and the left side of the printer 1. A direction in FIG. 3 from a thermal head 10 toward a discharge port 7 is the tape feed direction. In the tape feed direction, the side of the thermal head 10 is the upstream side in the tape feed direction and the side of the discharge port 7 is the downstream side in the tape feed direction. An operation by which the printer 1 transports the label tape 41 is referred to as a tape feed.

The configuration of the printer 1 will be briefly explained. As shown in FIG. 1, a keyboard 3 is provided on a front side portion of the top face of the printer 1. The keyboard 3 is an input device for inputting characters. The characters are, for example, letters, symbols, graphics or numerals etc. A function key group 4 is provided to the rear of the keyboard 3. The function key group 4 is an input device that includes a power source key, an ENTER key, a print key and the like. Note that, in the following explanation, the keyboard 3 and the function key group 4 are collectively referred to as an input portion 50.

A base portion 20 is provided to the rear of the function key group 4. A shape of the base portion 20 is a substantially triangular as seen from the left and right sides. A front face 21 of the base portion 20 is a rectangular shape that is horizontally long. A display 5 is provided in the front face 21. The display 5 is a rectangular shape that is horizontally long and that extends in parallel to the tape feed direction of the printer 1. A size of the display 5 is not limited, but in the present embodiment, the size of the display 5 is larger than the size of the label tape 41. The front face 21 inclines diagonally upward from the front toward the rear of the printer 1. When a user is positioned in front of the printer 1, the display 5 faces the user. Thus, it is easy for the user to see the display 5. In addition to various images, an image of the label tape 41 that is being printed is displayed in real time on the display 5.

A cover 6 is provided on a rear portion of the top face of the printer 1. The cover 6 has a substantially rectangular shape in the plan view. A rear end portion of the cover 6 is axially supported on the rear portion of the top face of the printer 1. As shown in FIG. 2, the cover 6 can be opened and closed around the rear end portion. When the cover 6 is opened upward, a cassette mounting portion 8 is exposed. A tape cassette 40 can be inserted into and removed from the cassette mounting portion 8. The tape cassette 40 houses the label tape 41 and an ink ribbon that is not shown in the drawings. The user mounts the tape cassette 40 in the cassette mounting portion 8 when the cover 6 is in an open state. A USB connection portion 16 is provided on the rear of the right side face of the printer 1. The USB connection portion 16 can be connected to a terminal of a USB cable that is not shown in the drawings. The printer 1 can be connected to a PC 200 (refer to FIG. 4) via the USB cable.

As shown in FIG. 2, the discharge port 7 is provided on the rear side of the left side face of the printer 1. The discharge port 7 discharges, to the outside, the printed label tape 41 that has been cut by a cutter mechanism 17, which will be explained later (refer to FIG. 3). A tape tray 22 is provided in the vicinity of the discharge port 7. The tape tray 22 can receive the printed label tape 41 that has been discharged from the discharge port 7.

An internal configuration of the cassette mounting portion 8 will be explained. The cassette mounting portion 8 is provided with a print mechanism and a tape feed mechanism. The print mechanism and the tape feed mechanism are each known mechanisms. As shown in FIG. 3, the print mechanism includes the thermal head 10 and a platen holder 11. The thermal head 10 is provided on the front side of the cassette mounting portion 8. The thermal head 10 has heater elements and prints an image on a print surface of the label tape 41 that has been pulled out from the tape cassette 40. The platen holder 11 is provided to the front of the thermal head 10. The platen holder 11 is arm-shaped. A platen roller 13 and a feed roller 14 are rotatably held on the left end side of the platen holder 11. The platen holder 11 can rotate around a shaft support portion 11A on the right end side of the platen holder 11. When the platen holder 11 rotates to the rear (upward in FIG. 3), the platen roller 13 is pressed by the thermal head 10, and the feed roller 14 is pressed against a tape drive roller 37 of the tape cassette 40.

The tape feed mechanism includes a ribbon take-up shaft 9 and a tape drive shaft 23. The ribbon take-up shaft 9 rotates via a drive mechanism that is not shown in the drawings as a result of driving of a tape feed motor 15 (refer to FIG. 4). The ribbon take-up shaft 9 takes up the ink ribbon after it has been pulled out from a ribbon spool (not shown in the drawings) of the tape cassette 40 and used for printing. The tape drive shaft 23 also rotates via the drive mechanism that is not shown in the drawings as a result of the driving of the tape feed motor 15 (refer to FIG. 4). Thus, the ribbon take-up shaft 9 and the tape drive shaft 23 are driven such that they are synchronized with each other. The tape drive roller 37 of the tape cassette 40 is mounted on the tape drive shaft 23. The printer 1 pulls out the label tape 41 from the tape cassette 40 by the tape drive roller 37 moving in concert with the feed roller 14. The printer 1 further feeds the label tape 41 that has been printed by the thermal head 10 toward the discharge port 7.

As shown in FIG. 3, the cutter mechanism 17 is provided on a feed path of the label tape 41 that runs between the thermal head 10 and the discharge port 7. The cutter mechanism 17 is provided with a moving blade 18, a fixed blade 19 and a cutter motor 12 (refer to FIG. 4). The moving blade 18 is positioned above (the upper side in FIG. 3) the feed path of the label tape 41 and the fixed blade 19 is positioned below (the lower side in FIG. 3) the feed path. The positions of the moving blade 18 and the fixed blade 19 may be reversed. The cutter motor 12 is driven as a result of an operation of the input portion 50 by the user. The moving blade 18 moves toward the fixed blade 19. The printed label tape 41 that is positioned between the moving blade 18 and the fixed blade 19 is cut in the width direction in this way.

A marker sensor 25 (refer to FIG. 4) is provided in the cassette mounting portion 8. The marker sensor 25 is a known optical sensor and has a light emitting element and a light receiving element. The marker sensor 25 detects a black colored end marker (not shown in the drawings) that is printed on the label tape 41 inside the tape cassette 40. The end marker is, for example, printed within a range of a predetermined length from an end edge of the label tape 41. The marker sensor 25 uses the light receiving element to detect light irradiated from the light emitting element and reflected from the label tape 41, and detects an intensity of the received light. The marker sensor 25 is provided, for example, in a position facing a window portion (not shown in the drawings) provided in the tape cassette 40. The marker sensor 25 detects the end marker (printed on the label tape 41) that is exposed from the window portion.

Figure 4:
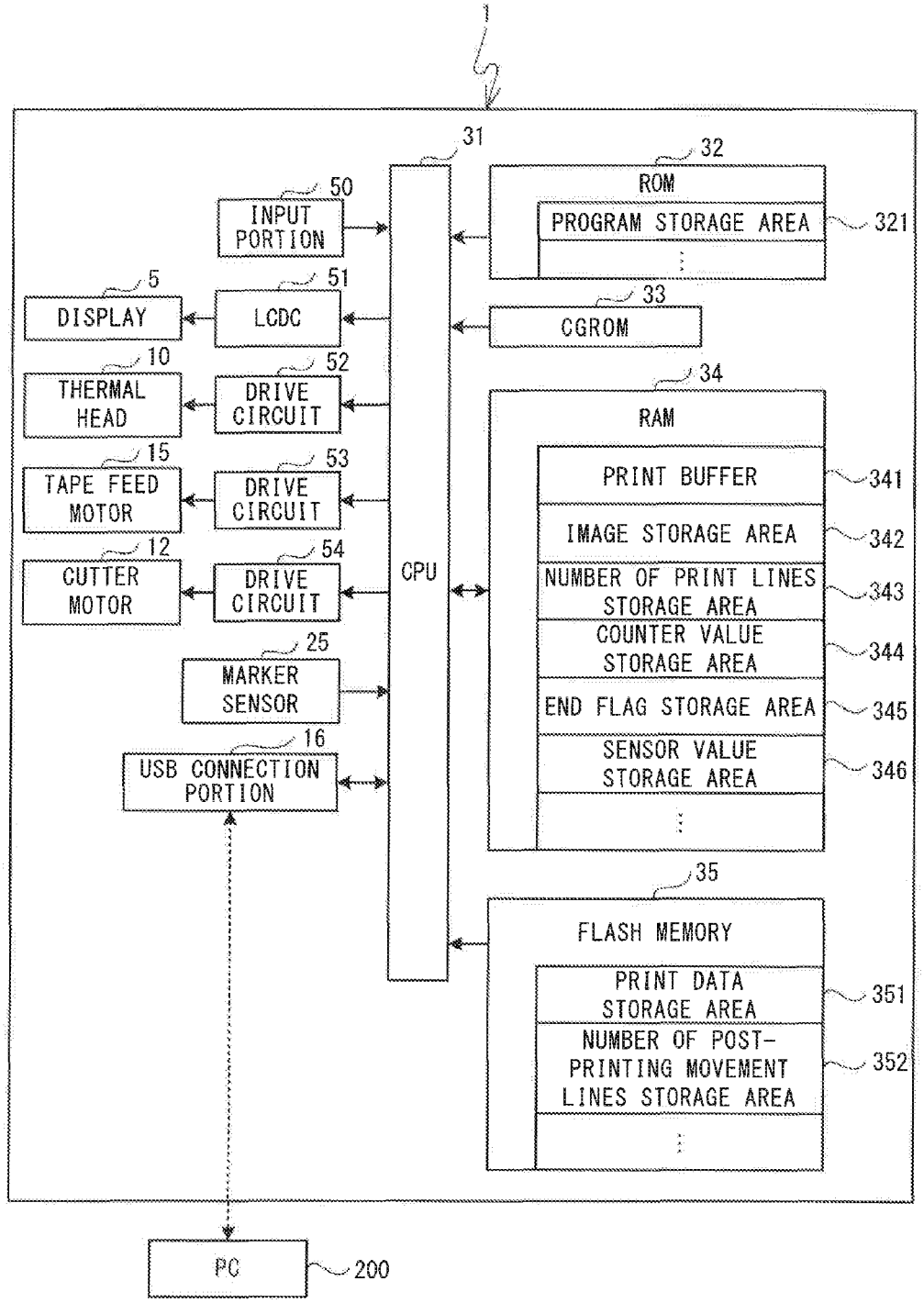
FIG. 4 is a block diagram showing an electrical configuration of the printer.

An electrical configuration of the printer 1 will be explained. As shown in FIG. 4, the printer 1 is provided with a CPU 31, a ROM 32, a CGROM 33, a RAM 34 and a flash memory 35. The CPU 31 controls operations of the printer 1. The ROM 32, the CGROM 33, the RAM 34 and the flash memory 35 are electrically connected to the CPU 31. The input portion 50, an LCDC 51, drive circuits 52 to 54, the marker sensor 25, and the USB connection portion 16 are also connected to the CPU 31. The LCDC 51 drives the display 5. The drive circuit 52 drives the thermal head 10. The drive circuit 53 drives the tape feed motor 15. The drive circuit 54 drives the cutter motor 12.

The ROM 32 is provided with a program storage area 321. Various programs used to control the printer 1 and a real time display and print program etc. are stored in the program storage area 321. The real time display and print program is a program that is used to perform real time display and print processing that will be explained later (refer to FIG. 5 and FIG. 6).

Size information used to display characters on the display 5 and print dot pattern data used to print the characters etc. are stored in the CGROM 33.

The RAM 34 is provided with at least a print buffer 341, an image storage area 342, a number of print lines storage area 343, a counter value storage area 344, an end flag storage area 345 and a sensor value storage area 346. Print data used at the time of printing is temporarily stored in the print buffer 341. Data of an image showing a state of the label tape 41 on which an image has been printed based on the print data is stored in the image storage area 342. A number of print lines N is stored in the number of print lines storage area 343. The number of print lines N is a number of all the lines by which the tape needs to be fed when printing, using the thermal head 10, the print data that is to be printed from now on.

A number of printed lines counter value (n) and a number of moved lines counter value (m) are stored in the counter value storage area 344. The number of printed lines is the number of lines of tape feed during printing. The number of moved lines is the number of lines of tape feed after printing. The number of printed lines and the number of moved lines are respectively counted by various counters. Each of the counted values are stored, as the number of printed lines counter value (n) and the number of moved lines counter value (m), in the counter value storage area 344. An end flag is stored in the end flag storage area 345. The end flag is switched on when the end marker of the label tape 41 is detected in tape end detection processing (refer to FIG. 7) that will be explained later. An intensity of light that is detected by the marker sensor 25 is stored as a sensor value in the sensor value storage area 346.

The flash memory 35 includes at least a print data storage area 351 and a number of post-printing movement lines storage area 352. Print data is stored in the print data storage area 351. The print data is data of the image that is printed on the label tape 41. For example, print data of various patterns, which are generated by the user using the input portion 50, is stored in the print data storage area 351. Further, print data that is received from the PC 200 is stored in the print data storage area 351. A number of post-printing movement lines M is stored in the number of post-printing movement lines storage area 352. The number of post-printing movement lines M is the number of lines necessary to feed the tape to a cutting position of the cutter mechanism 17 from the thermal head 10, after printing is complete.

The real time display and print processing will be explained with reference to flowcharts shown in FIG. 5 to FIG. 7, and step diagrams shown in FIG. 8 and FIG. 9. When the user instructs a start of printing of the print data selected on the input portion 50, the CPU 31 reads out the real time display and print program stored in the ROM 32, and performs the real time display and print processing.

Figure 8:
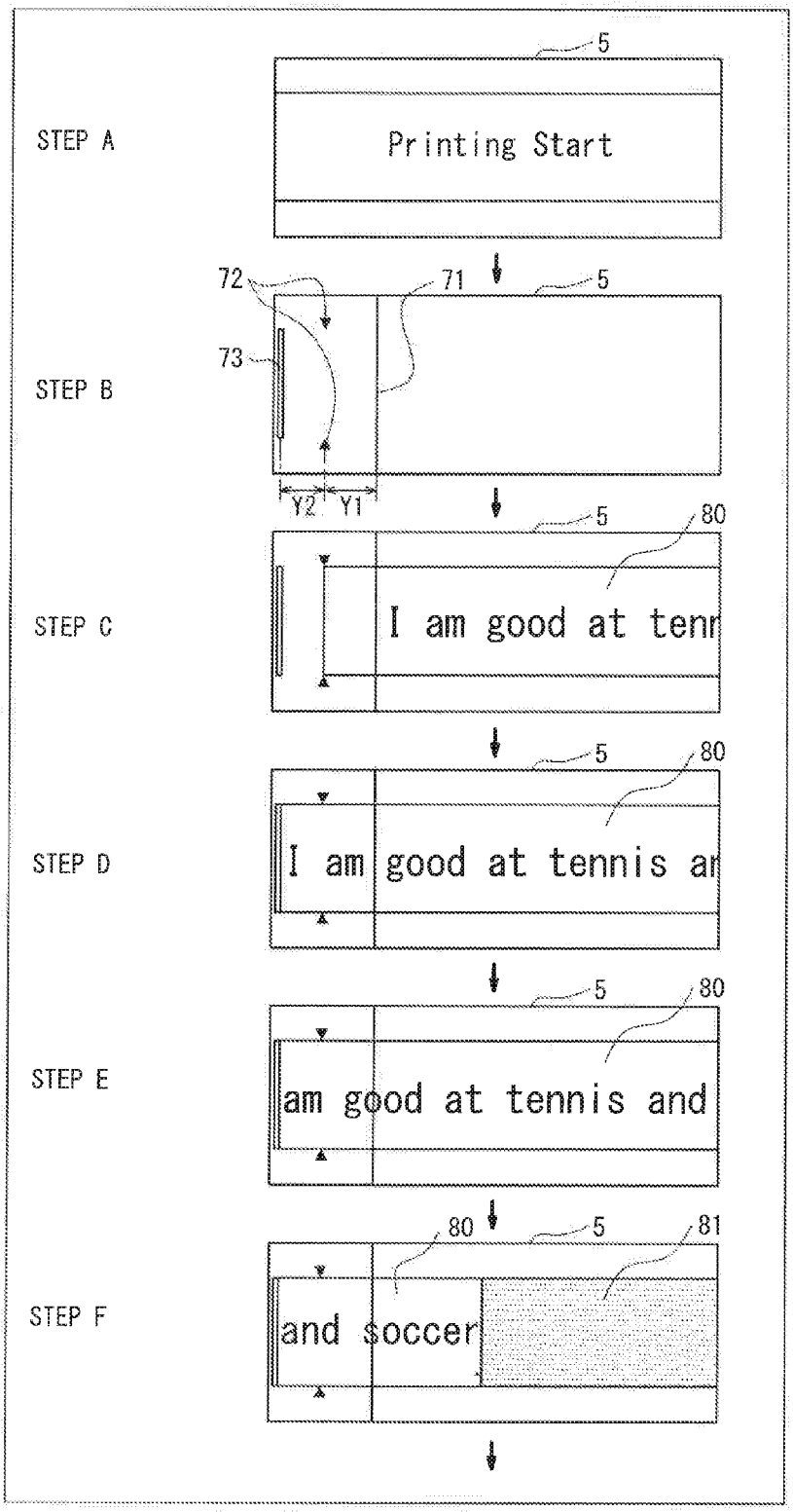
FIG. 8 is a step diagram showing a state in which an image displayed on a display is moved.
Figure 9:
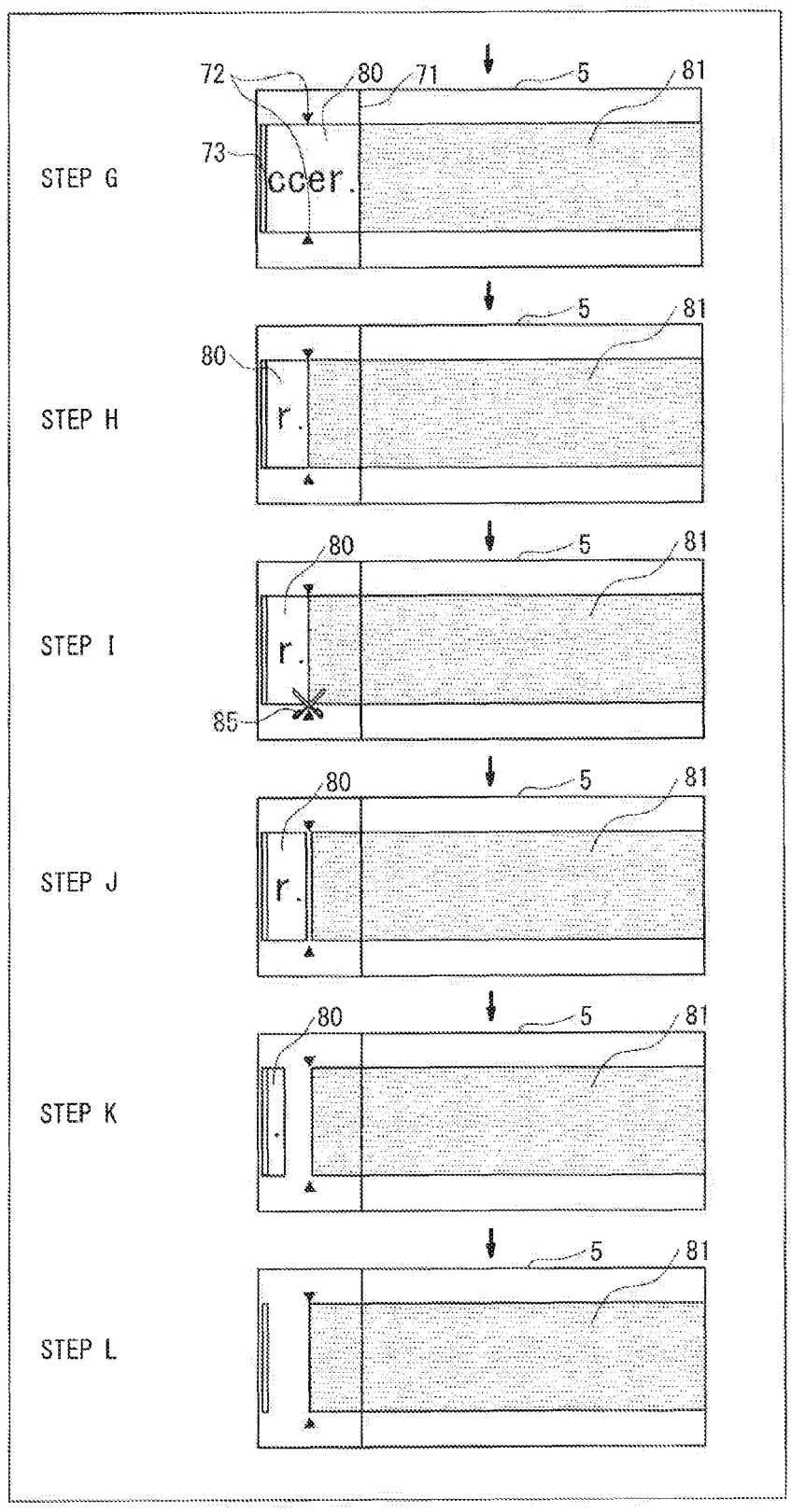
FIG. 9 is a step diagram and is a continuation of FIG. 8.

As shown by step A in FIG. 8, the CPU 31 first displays a "Printing Start" message in the center of the display 5 (S1). The CPU 31 resets both the counter value (n) and the counter value (m) that are stored in the counter value storage area 344 of the RAM 34 (S2 and S3). Based on a type of the print data selected by the user using the input portion 50, the CPU 31 generates an image 80 that represents the label tape 41 in a state in which the selected print data has been printed (S4). The CPU 31 stores data of the generated image 80 in the image storage area 342 of the RAM 34.

The CPU 31 respectively displays a head marker 71, cutter markers 72 and a discharge port marker 73 on the display 5 (S5). As shown by step B in FIG. 8, the head marker 71 is displayed by a straight line that intersects the display 5 in the up-down direction. The cutter markers 72 are displayed by a pair of upper and lower triangular markers. The discharge port marker 73 is displayed by a vertically-long rectangular marker that is colored in white. The head marker 71, the cutter markers 72 and the discharge port marker 73 are displayed on the left side of the display 5. Hereinafter, when the head marker 71, the cutter markers 72 and the discharge port marker 73 are collectively referred to, they are referred to as the markers 71 to 73. The markers 71 to 73 respectively correspond to mutual positional relationships of the thermal head 10, a cutting position of the cutter mechanism 17 and the discharge port 7, which are shown in FIG. 3. Specifically, the head marker 71 is displayed to the right side of the discharge port marker 73. The discharge port marker 73 is displayed to the left of the head marker 71. The cutter markers 72 are displayed between the head marker 71 and the discharge port marker 73.

As shown in FIG. 3, for example, a distance X1 is a distance from the thermal head 10 to the cutting position of the cutter mechanism 17, and a distance X2 is a distance from the cutting position of the cutter mechanism 17 to the discharge port 7. At step B shown in FIG. 8, a distance Y1 is a distance from the head marker 71 to the cutter markers 72, and a distance Y2 is a distance from the cutter markers 72 to the discharge port marker 73. A ratio between the distance Y1 and the distance Y2 is the same as a ratio between the distance X1 and the distance X2. Note that, in the present embodiment, the distance X1 is the same as the distance Y1, and the distance X2 is the same as the distance Y2.

The CPU 31 performs initial display of the image 80 of the label tape 41 on the display 5 (S6). As shown by step C in FIG. 8, the image 80 is displayed as the same shape as the label tape 41, and is arranged in parallel to the actual tape feed direction. A sentence that reads "I am good at tennis and soccer.", for example, is displayed reading from left to right inside a frame of the image 80. At this time, the CPU 31 performs initial display such that a starting edge of the image 80 is aligned with the head marker 71.

The CPU 31 calculates the number of print lines N (S7). The number of print lines N is the total number of tape feed lines necessary to print the sentence shown by the image 80. The CPU 31 calculates the number of print lines N based on the print data stored in the print buffer 341 of the RAM 34. The CPU 31 stores the calculated number of print lines N in the number of print lines storage area 343 of the RAM 34.

The CPU 31 performs printing of one line (S8). When the thermal head 10 prints the one line, the tape feed mechanism feeds the label tape 41 by one line to the discharge port 7 side. Further, the CPU 31 moves the image 80 that is displayed on the display 5 by one line to the left (S9). As a result, the image 80 is displayed on the display 5 in a state in which it has moved in the same direction as the tape feed direction and has moved by the same distance as the actual label tape 41. The CPU 31 performs the tape end detection processing (S10).

The tape end detection processing will be explained with reference to the flowchart shown in FIG. 7. The CPU 31 reads a sensor value that is an intensity of light detected by the marker sensor 25 (S31). The CPU 31 stores the read sensor value in the sensor value storage area 346 of the RAM 34 (S32). The sensor value is a value that is obtained by converting the intensity of the light detected by the marker sensor 25 into a voltage (V).

The CPU 31 determines whether the sensor value that the CPU 31 has stored in the sensor value storage area 346 of the RAM 34 is a value that indicates the black colored end marker for all of a past S times (3 times, for example) (S33). For example, the CPU 31 determines the sensor value to be the value indicating the black colored end marker when it is a value equal to or lower than a predetermined level. For example, when even one of the sensor values of the past S times is the value indicating the black colored end marker (no at S33), the CPU 31 does not determine that the end marker has been detected and advances the processing directly to S11 shown in FIG. 5.

When the sensor values for the past S times are all the values that indicate the black colored end marker (yes at S33), the CPU 31 determines that the end marker has been detected.

Thus, the CPU 31 switches on the end flag that is stored in the end flag storage area 345 of the RAM 34 (S34). The CPU 31 advances the processing to S11 shown in FIG. 5.

The CPU 31 determines whether the end flag is on (S11). When the end flag stored in the end flag storage area 345 of the RAM 34 is off (no at S11), the CPU 31 determines whether the line this time (a current line) is in a tape end area (S13).

The tape end area will be explained. The distance from the marker sensor 25 to the thermal head 10 is stored in advance in the flash memory 35 of the printer 1. For example, when the end marker is detected by the marker sensor 25, the CPU 31 stores, in the RAM 34, the print position on the image 80 at the point in time at which the end marker is detected. The CPU 31 converts the distance from the marker sensor 25 to the thermal head 10, which has been stored in advance in the flash memory 35, into a number of lines, and adds the number of lines to the print position stored in the RAM 34. As a result, on the image 80, the CPU 31 can identify which of the lines corresponds to the tape end (the end of the tape). The tape end area is an area on the upstream side of the tape end on the image 80.

Figure 5:
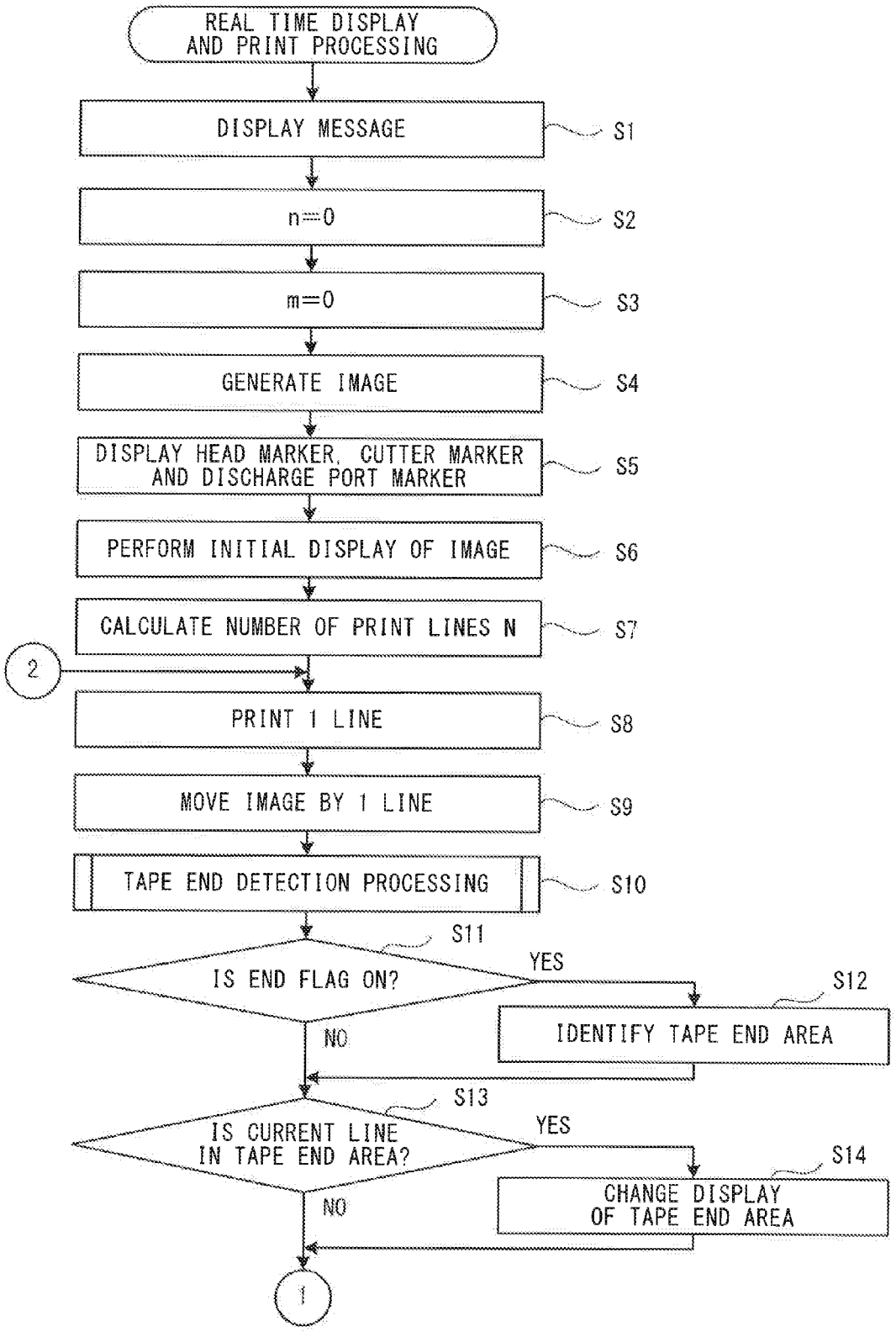
FIG. 5 is a flowchart of real time display print processing.
Figure 6:
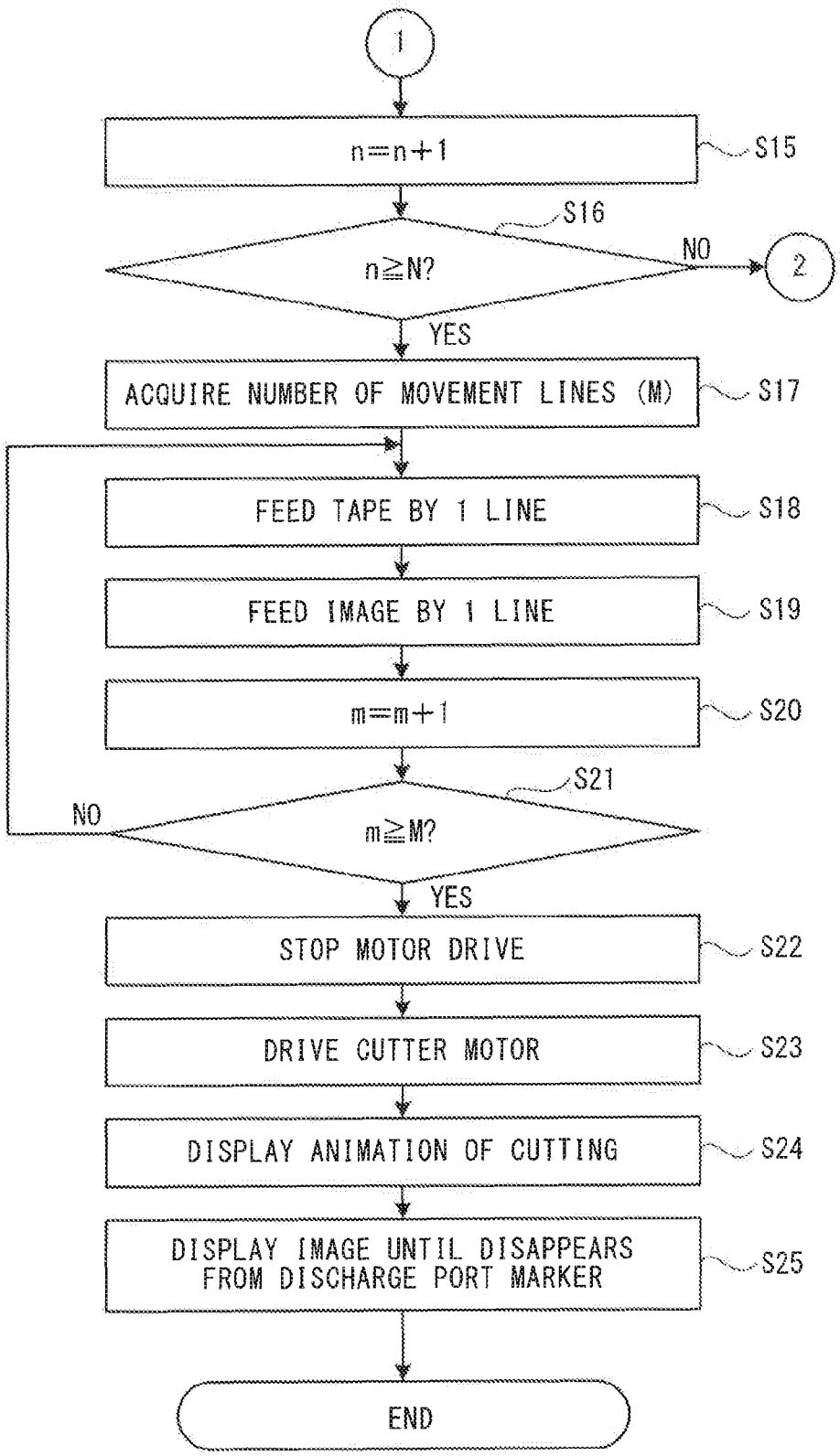
FIG. 6 is a flowchart showing a continuation of FIG. 5.
Figure 7:
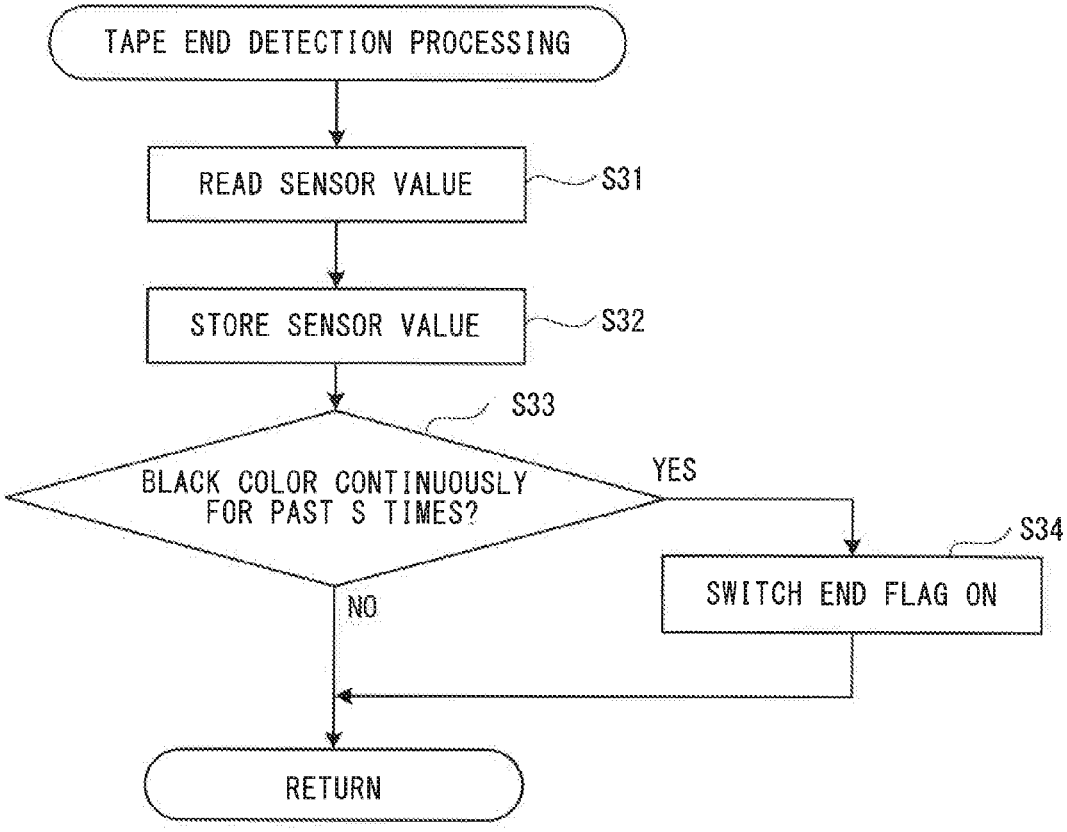
FIG. 7 is a flowchart of tape end detection processing.

When the CPU 31 determines that the current line is not in the tape end area (no at S13), as shown by the flowchart in FIG. 6, 1 is added to the counter value (n) that is stored in the counter value storage area 344 of the RAM 34 (S15). The CPU 31 determines whether the counter value (n) stored in the counter value storage area 344 is equal to or greater than the number of print lines N (S16). When the CPU 31 determines that the counter value (n) is less than the number of print lines N (no at S16), the CPU 31 returns the processing to S8 shown in FIG. 5. The CPU 31 repeats the processing from S8 to S16 until the counter value (n) reaches the number of print lines N (S8 to S16). As a result, as shown by steps D, E and F in FIG. 8, the image 80 is displayed moving at the same speed and in the same direction as the tape feed of the actual label tape 41.

It should be noted that, when the end edge of the image 80 is positioned on the right end of the display 5, continuing to the right side of the end edge of the image 80, an image 81 is displayed that represents the blank label tape 41 on which nothing has been printed. The image 81 is displayed in gray, for example, and thus the user can distinguish between the image 81 and the image 80.

When the CPU 31 determines that the counter value (n) is equal to or greater than the number of print lines N (yes at S16), the printing by the thermal head 10 is ended. The CPU 31 acquires the number of post-printing movement lines M from the number of post-printing movement lines storage area 352 of the flash memory 35 (S17). The CPU 31 feeds the label tape 41 by one line (S18). The CPU 31 moves the image 80 on the display 5 by one line toward the left (S19). In this manner, the image 80 is displayed on the display 5 in a state in which it has been moved by the same distance as the actual label tape 41 in the same direction as the tape feed direction.

The CPU 31 adds 1 to the counter value (m) stored in the counter value storage area 344 of the RAM 34 (S20). The CPU 31 determines whether the counter value (m) stored in the counter value storage area 344 is equal to or greater than the number of post-printing movement lines M (S21). When the CPU 31 determines that the counter value (m) is less than the number of post-printing movement lines M (no at S21), the CPU 31 returns the processing to S18. The CPU 31 repeats the processing at S18 to S21 until the counter value (m) reaches the number of post-printing movement lines M. In this manner, as shown by step G in FIG. 9, the image 80 on the display 5 is displayed moving at the same speed and in the same direction as the tape feed of the actual label tape 41.

When the CPU 31 determines that the counter value (m) is equal to or greater than the number of post-printing movement lines M (yes at S21), the CPU 31 stops the driving of the tape feed motor 15 (S22). At that time, the label tape 41 is fed until a position of the end of the sentence "I am good at tennis and soccer." that is printed on the print surface reaches the cutting position of the cutter mechanism 17. Meanwhile, as shown by step H in FIG. 9, on the display 5, the image 80 is moved until the end edge of the image 80 reaches a cutting position of the cutter marker 72.

The CPU 31 drives the cutter motor 12 (S23). When the cutter motor 12 is driven, the moving blade 18 moves toward the fixed blade 19. Thus, the printed label tape 41 that is positioned between the moving blade 18 and the fixed blade 19 is cut in the width direction. The CPU 31 displays an animation of the cutting on the display 5 (S24). As an example of the animation of the cutting, as shown by step I in FIG. 9, first a scissors marker 85 is displayed at the position of the cutter marker 72. After that, as shown by step J, the image 80 and the image 81 are displayed separated by a gap opening along a boundary line. In this manner, on the display 5 of the printer 1, it is possible to realistically display the label tape 41 being cut.

The CPU 31 feeds and displays the image 80 until the image 80 disappears from the discharge port marker 73 (S25). As shown by step K and step L in FIG. 9, the image 81 does not move on the display 5 and is displayed in gray while remaining in the same position. Only the image 80 is moved. The printer 1 can thus reliably reproduce, on the display 5, the actual printing status inside the printer 1. The CPU 31 ends the real time display and print processing in this manner.

Figure 10:
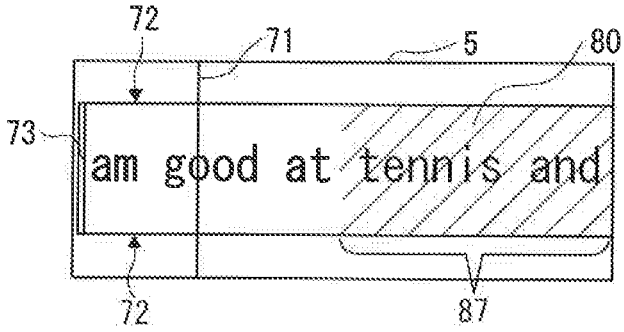
FIG. 10 is a diagram showing a state in which, on the display, an end marker is displayed overlapped with a tape end area of the image.

When the CPU 31 determines at S11 shown in FIG. 5 that the end flag stored in the end flag storage area 345 of the RAM 34 is switched on (yes at S11), the CPU 31 identifies the tape end area (S12). The method of identifying the tape end area is as described above. When the CPU 31 determines that the current line is in the tape end area (yes at S13), the CPU 31 changes the display of a portion of the image 80 that corresponds to the identified tape end area (S14). For example, when a position corresponding to the tape end is positioned on the right end of the display 5, an area that is displayed by moving the image 80 beyond that position is the tape end area. The CPU 31 displays the tape end area and a striped end edge marker 87 overlapped with each other on the display 5 (refer to FIG. 10). In this way, the user can recognize, on the display 5, that the label tape 41 will end during printing. In this case, the user can rapidly respond to the situation by stopping the printing, exchanging the tape cassette for a new tape cassette and restarting the printing etc.

As explained above, in the printer 1 of the present embodiment, when printing is instructed using the input portion 50, the head marker 71, the cutter marker 72 and the discharge port marker 73 are displayed on the display 5. The markers 71 to 73 are displayed in positions corresponding to the thermal head 10, the cutter mechanism 17 and the discharge port 7, respectively. The image 80 is initially displayed on the display 5 such that the start edge of the image 80 of the label tape 41 is aligned with the head marker 71. In accordance with the line-by-line printing operation by the thermal head 10, the printer 1 moves the image 80 line-by-line in the same direction as the tape feed direction and displays the image 80 on the display 5. In this manner, the printing situation inside the printer 1 is reproduced on the display 5. Using the realistic display on the display 5, the user can more specifically ascertain the printing situation inside the printer 1. Further, the user can see, during printing, which part of the label tape 41 is being printed by the thermal head 10 and which part of the label tape 41 is passing through the discharge port 7. As a result, the user can more specifically ascertain the printing situation inside the printer 1.

In the above-described embodiment, the cutter marker 72 is displayed on the display 5 and thus, when the user operates the cutter mechanism 17, the user can easily see which part of the label tape 41 is being cut.

In the above-described embodiment, the printer 1 detects the end marker printed on the end edge of the label tape 41 using the marker sensor 25, and thus identifies the tape end area of the label tape 41. The printer 1 displays the tape end area and the striped end edge marker 87 overlapped with each other on the display 5. In this way, the user can see up to which part of the image 80 printing is possible on the label tape 41 that is being printed.

The present disclosure is not limited to the above-described embodiment, and various modifications are possible. For example, in the above-described embodiment, when the instruction for printing is made by the user, the CPU 31 displays the markers 71 to 73 on the display 5. After that, the CPU 31 displays the image 80 on the display 5. However, the markers 71 to 73 may be provided in advance on a screen of the display 5 or may be provided in advance in a frame of the display 5.

Further, in the above-described embodiment, the label tape 41 housed in the tape cassette 40 is a receptor type tape that transfers the image using the ink ribbon. However, the label tape 41 may a heat-sensitive type tape or may be a laminate type tape and a structure of the label tape is also not limited.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a print head that performs printing of a print image on a print medium, based on print data;

a discharge port that discharges the print medium to the outside after the printing by the print head;

a display portion that displays various images; and a processor that is configured to display a head marker indicating a position of the print head and a discharge port marker indicating a position of the discharge port on the display portion in correspondence to a positional relationship of the print head and the discharge port, and display, in real-time on the display portion, an image of the print medium on which the print image has been printed, in accordance with the printing by the print head, such that the image is initially displayed in a state in which a start edge of the image is aligned with the head marker when the printing by the print head starts, and a position of the initially displayed image is moved toward the discharge port marker in accordance with progress of the printing by the print head.

2. The printer according to claim 1, further comprising:

a cutting portion that is provided between the print head and the discharge port and that cuts, in a width direction, the print medium printed by the print head;

wherein the displaying the head marker and the discharge port marker includes displaying, on the display portion, a cutting marker indicating a position of the cutting portion, the head marker and the discharge port marker in correspondence to a positional relationship of the print head, the cutting portion and the discharge port.

3. The printer according to claim 1, further comprising:

an end edge detection portion that detects an end edge of the print medium;

wherein the processor is further configured to identify an end position, which is a position of the end edge on the image, in accordance with the detection of the end edge by the end edge detection portion, and wherein the displaying the image includes displaying, in real time on the display portion, the image reflecting an end edge marker indicating the end edge at the identified end edge position.

4. A printer comprising:

a print head that performs printing of a print image on a print medium, based on print data;

a discharge port that discharges the print medium to the outside after the printing by the print head;

a display portion that displays various images, the display portion being provided with a head marker indicating a position of the print head and a discharge port marker indicating a position of the discharge port in correspondence to a positional relationship of the print head and the discharge port; and a processor that is configured to display, in real-time on the display portion, an image of the print medium on which the print image has been printed during printing by the print head, such that the image is initially displayed in a state in which a start edge of the image is aligned with the head marker, when the printing by the print head starts, and a position of the initially displayed image is moved toward the discharge port marker in accordance with progress of the printing by the print head.

5. The printer according to claim 4, further comprising:

a cutting portion that is provided between the print head and the discharge port and that cuts, in a width direction, the print medium printed by the print head;

wherein the displaying the head marker and the discharge port marker includes displaying, on the display portion, a cutting marker indicating a position of the cutting portion, the head marker and the discharge port marker in correspondence to a positional relationship of the print head, the cutting portion and the discharge port.

6. The printer according to claim 4, further comprising:

an end edge detection portion that detects an end edge of the print medium;

wherein the processor is further configured to identify an end position, which is a position of the end edge on the image, in accordance with the detection of the end edge by the end edge detection portion, and wherein the displaying the image includes displaying, in real time on the display portion, the image reflecting an end edge marker indicating the end edge at the identified end edge position.

* * * * *